United States Patent [19]

Genähr et al.

[11] Patent Number: 5,021,766

[45] Date of Patent: Jun. 4, 1991

[54] INTRUSION DETECTION SYSTEM

[75] Inventors: Rudolf Genähr, Männedorf; Hansjürg Mahler, Hombrechtikon, both of Switzerland

[73] Assignee: Cerberus AG, Switzerland

[21] Appl. No.: 372,317

[22] Filed: Jun. 28, 1989

[30] Foreign Application Priority Data

Jun. 28, 1988 [CH] Switzerland ..... 0244388

[51] Int. Cl.[5] ..... G08B 13/20

[52] U.S. Cl. ..... 340/544; 340/522; 340/566

[58] Field of Search ..... 340/544, 566, 665–666, 340/555, 522, 527, 508

[56] References Cited

U.S. PATENT DOCUMENTS

| | | | |
|---|---|---|---|
| 3,438,021 | 4/1969 | Nelkin et al. | 340/566 |
| 3,611,341 | 10/1971 | Craig et al. | 340/544 |
| 3,831,162 | 8/1974 | Armstrong | 340/566 X |
| 3,965,751 | 6/1976 | Harvalik | 73/654 X |
| 4,400,695 | 8/1983 | Rittenbach et al. | 340/566 |
| 4,450,434 | 5/1984 | Nielsen et al. | 340/555 X |
| 4,538,140 | 8/1985 | Prestel | 340/566 X |
| 4,591,709 | 5/1986 | Koechner et al. | 340/555 X |
| 4,746,910 | 5/1988 | Pfister et al. | 340/522 X |

OTHER PUBLICATIONS

"Chapter Ten: Detection of Radar Signals in Noise", *Introduction to Radar Systems* 2nd ed., Merrill I. Skolnik, McGraw Hill Book Co.

*Primary Examiner*—Glen R. Swann, III
*Assistant Examiner*—Thomas J. Mullen, Jr.
*Attorney, Agent, or Firm*—Brumbaugh, Graves, Donohue & Raymond

[57] ABSTRACT

A pressure sensitive perimeter intrusion detector comprises at least two pressure sensitive housing members adapted for the transmission of acoustic waves in response to pressure applied to the exterior of the housing members. Each housing member is capable of providing a first electric signal in response to seismic waves or ground vibrations. In addition, distributed along the housing members are pressure-sensing elements for detecting pressure applied along the housing members. These pressure-sensing elements for each housing member provide a second electric signal having substantially no time delay. The first and second electric signals are transmitted to an evaluation circuit adapted to produce an alarm signal in response to the detection of an intrusion occurrence.

22 Claims, 2 Drawing Sheets

INTRUSION DETECTION SYSTEM

BACKGROUND OF THE INVENTION

The present invention relates to an intrusion detection system useful in perimeter protection. More particularly, the invention relates to an intrusion detection system using at least two fluid-filled flexible tube members containing a fluid capable of transmission of energy pulses in response to pressure applied to the external portion of the flexible tube members. The flexible tube members are placed at a certain distance below ground level along the boundary to be protected. Energy pulses are detected by transducers located at least at the ends of the flexible tube members which are capable of converting mechanical energy (vibration) pulses into electrical signals. The novel intrusion detection system further comprises control and indicating equipment including an evaluating circuit to produce an alarm signal if pressure changes or vibrations in the fluid in the tubes indicate the penetration of the boundary to be protected.

U.S. Pat. No. 4,400,695 discloses an intrusion detection system for perimeter surveillance, i.e., for the surveillance of the boundaries of outdoor areas against unauthorized trespass by intruders or against breach of the boundaries by vehicles. This system utilizes two fluid-filled tubes buried within a few feet of each other. Seismic disturbances (vibrations) caused by an intruder are transformed into pressure pulses and transmitted to transducers positioned at the ends of the tubes. The output signals of these transducers are evaluated in an evaluating circuit. In order to minimize false alarms, an alarm signal is only produced if the difference between the signals of the two tubes exceeds a predetermined threshold value. The location of the intrusion can be detected by measuring the time difference between receipt of the mechanical impulse at the transducers at both ends of the tubes. Accordingly, the intrusion detection system only evaluates a single physical quantity for producing an alarm signal, i.e., the amplitude of the seismic disturbances or vibrations. Such a system is not suitable to distinguish between an intruder, i.e., a genuine alarm situation and other causes of vibrations, for instance vibrations caused by small animals crossing the boundary, vibrations caused by distant vehicles or vibrations caused by weather or other environmental conditions.

As a result of this limitation, false alarms frequently occur. Furthermore, it is difficult, if not impossible, to detect the location of the intrusion occurrence if several pulses are produced simultaneously or within short time intervals, for instance by several intruders or by a single intruder producing signals in rapid succession, e.g., footsteps.

It is an object of the present invention to overcome the above-described disadvantages of the prior art intrusion detection systems and in particular to provide an intrusion detection system which detects an intrusion occurrence with improved selectivity and sensitivity so as to distinguish between vibrations resulting from environmental conditions and genuine intrusive acts. A further object is to provide an intrusion detection system with improved security against sabotage and circumvention and which permits precise identification of the location of an intrusion occurrence.

SUMMARY OF THE INVENTION

The present invention includes an intrusion detection system comprising two fluid-filled housing members (S1, S2) buried in the ground within a small distance of each other and being capable of transmission of energy pulses in response to pressure applied to the external portion of the flexible tube members. Each fluid-filled hose comprises electroacoustic transducers (P1, P2) placed at least at one end of the flexible tube members (S1, S2) and an elongated continuous linear pressure sensor element (K1, K2) extending along the total length of said sensor tube members (S1, S2) whereby an energy pulse, i.e., a seismic disturbance, vibration or pressure wave occurring at any location along said pressure sensor elements (K1, K2) produces without substantial time delay an electrical signal at the ends of said linear pressure sensor elements (K1, K2) said electrical signal being transmitted to an evaluation circuit E in a control and indication equipment (CIE). The evaluation circuit E comprises a time difference change circuit TDC adapted to transmit a signal if the absolute quantity of the time difference $[T=(t2-t1)]$ of the correlated electrical signals received from said linear pressure sensor elements (K1, K2) decreases more than a predetermined value or changes its sign within a predetermined time interval.

The evaluation circuit E further comprises circuit means which are adapted to determine in the above-described situation the amplitude of at least one of the signals received from the linear pressure sensor elements (K1, K2) and to produce an alarm signal if this amplitude or its time integral exceeds a predetermined threshold value. According to a preferred embodiment of the invention, the evaluation circuit E comprises further circuit means adapted to measure the time difference between the signals received from at least one of the linear pressure sensor elements (K1, K2) and from one of the electroacoustic transducers (P1, P2,) respectively, at the ends of the flexible tube members (S1, S2). This time difference is dependent on the acoustic velocity in the fluid in the tube members (S1, S2) and on the length of the path which the acoustic pressure wave has to travel through the tube members (S1, S2). Consequently, the time difference between the signals is a measure of the distance of the action on the tube members (S1, S2) and it is possible to locate the act of intrusion.

The evaluation circuit E not only evaluates the amplitudes of the pressure values in both the flexible tube members (S1, S2), [hereinafter also referred to as "sensor tubes", or "housing members"] as in the prior art intrusion detection systems, but also combines in a substantially more efficient evaluation method several measurable variables. For example, the time difference between the arrival of the signals received through the linear pressure sensor elements (K1, K2) [hereinafter also designated as "pressure sensitive cables"], which is independent of the amplitude of the signals, may be determined. This time difference corresponds to the elapsed time between the acoustic pressure wave and the linear pressure sensor elements (K1, K2). From the sign of this time difference, it can be computed on which side of the border the source of the vibrations, e.g., an intruder, is located. Referring to FIG. 1, a decrease of the absolute value of this time difference, or a change of the sign of this time difference, is a reliable indication of the fact that the source of the vibration has moved into the area C between the two pressure sensitive cables (K1, K2) or traversed both cables, i.e., has moved into area B. Only if this intrusion is detected by the time discriminator circuit, CTD, the amplitude, which is measured simultaneously, is evaluated. Since this amplitude is a measure of the mass of the intruding object, an alarm signal is only produced if this amplitude or its time integral, i.e., the mass of the object, is within a predetermined range, e.g., exceeds a predetermined threshold value. Accordingly, the absence of false alarms of the intrusion detection system of the present invention is enhanced by this mode of operation.

By evaluating the time difference between the arrival of the signals of the two pressure sensitive cables K1, K2 only the signal of such events which actually breach the perimeter are processed. Sources of vibrations far away and the influence of weather or other environmental conditions are excluded from processing. While small and light weight objects, e.g., animals, are detected by the time difference evaluation, they are excluded as a source for an alarm by the amplitude evaluation. Human beings and heavy vehicles, however, are identified as objects to be monitored. Even an intruder moving very slowly and cautiously will be detected by the evaluation circuit. The time difference evaluation which works without amplitude thresholds therefore detects weak vibrations also, and such intruder is detected by the pressure wave caused by his weight. Even if an intruder should jump over the sensor tubes (S1, S2), assuming he knows of their location, his presence will be positively detected, since the sign of the detected time difference changes within a short time interval and since simultaneously a sufficiently high value of the amplitude is observed.

The use of an elongated continuous linear pressure sensor element (K1, K2), for instance, a piezoelectric cable or pressure sensitive fiber optics, has the great advantage that the signals are transmitted practically with the velocity of light, i.e., substantially without any delay of time, to the evaluation circuit E, and that the problems caused by the differences between the transmission times of the pressure waves in the fluids of the two sensor hoses (S1, S2), e.g., where the cables are laid in an arc, are eliminated. Furthermore, the comparison of the time difference between the signals transmitted in the linear pressure sensor element (K1, K2) and transmitted in the fluid in the sensor tube (S1, S2) enables a more precise location of the intrusion act than with the prior art intrusion detection systems, particularly where a correlation circuit is used which enables a precise location of the intrusion act even when multiple vibrations occur.

The invention and its mode of operation will be more fully understood from the following detailed description read in connection with the accompanying drawings.

DETAILED DESCRIPTION OF THE PREFERRED EMBODIMENTS

Figure 1:
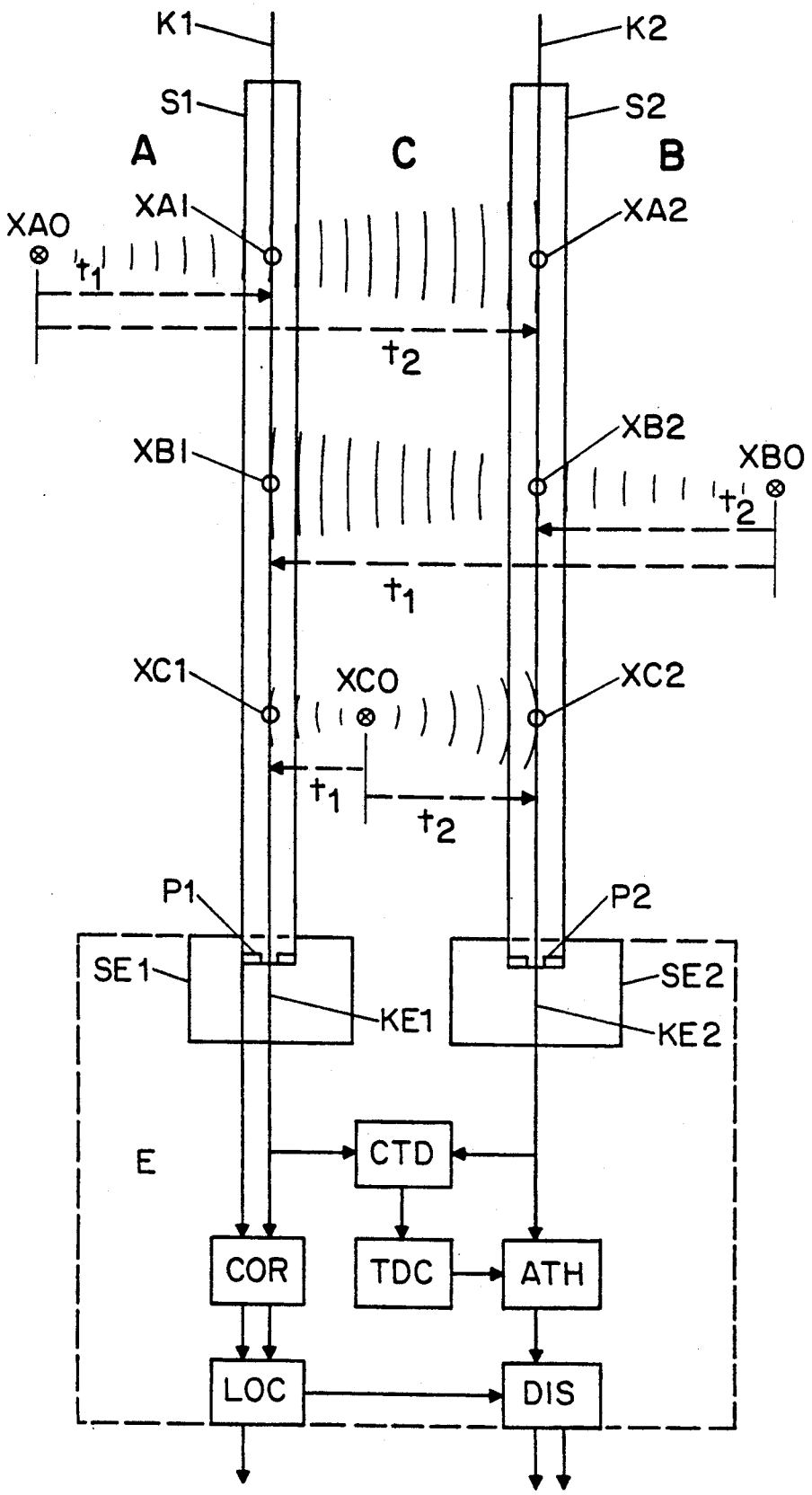
FIG. 1 is a block diagram of the intrusion detection system with two sensor tubes connected to a signal processing unit.

FIG. 1 shows a straight portion of the intrusion detection system where at the border of the protected area two sensor tubes (S1, S2) are buried approximately 25cm underground and approximately 1–2m apart and parallel to each other. The material of the tubes may be a flexible material like rubber or plastics or even a metallic pipe. The tubes are filled with a sound conducting medium, for example a freeze-resistant liquid such as a mixture of water and glycerine, or a suitable gel or gas. At the ends of the sensor tubes (S1, S2) electroacoustic transducers (P1, P2) are provided. If seismic waves, or ground vibrations, reach the sensor tubes (S1, S2) anywhere, these waves cause secondary pressure waves in the fluid medium within the tubes, running with a velocity of approximately 1.5 km/s (water) to the ends of the tubes. The electroacoustic transducers (P1, P2) produce an electrical signal which is transmitted to the evaluation circuit E. The construction of the sensor tubes (S1, S2) and the electroacoustic transducers (P1, P2) are well-known in the art, for instance as described in U.S. Pat. No. 3,438,021. Preferably, the electroacoustic transducers are piezoelectric elements.

The sensor tubes (S1, S2) further comprise linear pressure sensor elements (K1, K2) which extend over the entire length of said sensor tubes (S1, S2). The linear sensor elements are preferably pressure sensitive cables provided inside the sensor tubes (S1, S2) in contact with the sound conducting medium. Several pressure sensitive cables are known, for instance, a piezoelectric cable of the PVFD type, available from the Pennwalt Corporation or the Raychem Corporation, or the "electret" cable described in U.S. Pat. No. 3,831,162. In accordance with the present invention, when these cables are exposed to seismic waves or pressure waves, they produce an electrical signal at the end of the cables which is transmitted to control and indicating equipment CIE comprising an evaluation circuit E. The pressure sensitive cable may also be a fiber optic cable which changes the intensity of light transmitted through the cable if it is subjected to pressure. Such fibers are described in U.S. Pat. No. 4,591,709. The fiber optic cables would require a light emitting diode at one end and a light sensitive receiver at the other end in order to generate electrical signals corresponding to the disturbance created by the seismic waves reaching the tubes. These electrical signals would also be transmitted to the evaluation circuit E.

By placing the pressure sensitive cables (K1, K2) inside the liquid-filled tubes (S1, S2), the acoustic coupling of the cables to the surrounding ground which is achieved is superior to that obtained when burying the pressure sensitive cables separately in the ground. Both sensor pairs, the pressure sensitive transducers (P1, P2) and the pressure sensitive linear sensors (K1, K2) receive similar signals and consequently can be easily correlated to each other. In the medium within the sensor tubes (S1, S2), the signals are transmitted with the velocity of sound, while in the linear sensors (K1, K2), they are transmitted nearly with the velocity of light, i.e., with no substantial time delay.

Figure 2A:
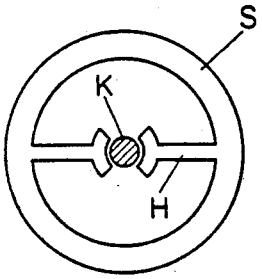
FIG. 2(*a–c*) show cross-sectional views of preferred embodiments of sensor tubes.

FIG. 2*a* shows a cross-sectional view of a sensor tube S comprising a linear pressure sensor element K fixed coaxially in the sensor tube S by means of the holding means H.

Figure 2B:
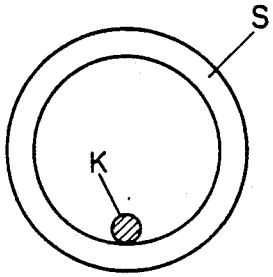

FIG. 2*b* shows a cross-sectional view of a sensor tube S comprising a linear pressure sensor element K fixed directly to the wall of the sensor tube S. It should also be understood that the linear pressure sensor element K may loosely lay on the wall of the sensor tubes.

Figure 2C:
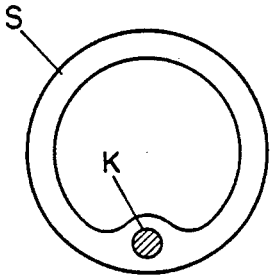

FIG. 2*c* shows a cross-sectional view of a sensor tube S comprising a linear pressure sensor element K incorporated into the wall of the sensor tube S. Preferably, this is done while producing the sensor tube S. The sensor tube S may then be buried into the ground as it is delivered without the need of inserting the pressure sensitive element K into the sensor tube S.

Figure 3:
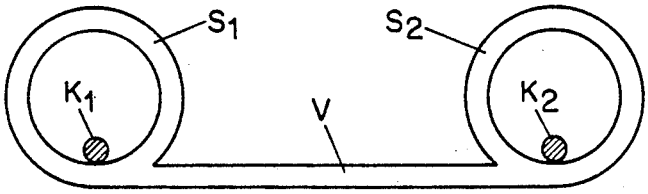
FIG. 3 is a cross-sectional view of a double sensor tube.

FIG. 3 shows a cross-sectional view of two connected sensor tubes (S1, S2) each comprising linear pressure sensor elements K1 and K2. The two sensor tubes (S1, S2) are connected by a continuous or latticed spacer device V to form a unit having a fixed spacing, e.g., 10cm. The running time of sound between the two sensor tubes (S1, S2) now will be approximately 0.1 msec and can easily be interpreted, preferably by using a change of sign signal processing to form an alarm signal. This will be described in more detail below. The double sensor tube may easily be stored and buried into the ground especially when filled with a gel-like medium.

The mode of operation of the novel intrusion system disclosed hereinabove is explained in greater detail with reference to the block diagram of FIG. 1 and FIG. 4, and the typical course of a time difference signal is described when an intruder crosses the border.

An intruder, outside the boundary to be protected, i.e., in area A at location XAO, produces seismic waves which reach the elongated continuous linear pressure sensor element (pressure sensitive cable) K1 inside the liquid-filled flexible sensor hose members (outer sensor tube) S1 after the time (t1), and the pressure sensitive cable K2 inside the inner sensor tube S2 after the time (t2). With virtually no time delay the pressure sensitive cables K1, K2 transmit corresponding electrical signals via cable terminators, KE1, KE2 to the receiving terminals SE1, SE2 in the evaluation circuit E. The output signals of the receiving terminals SE1, SE2 are transmitted to the time discriminator circuit, CTD, wherein the two signals are correlated and wherein the time difference, T, corresponding to (t2−t1) is measured, provided that the degree of correlation between the two signals is sufficient. The time difference T is a measure of the running time of the seismic waves between the points XA1 and XA2 of the two sensor tubes S1, S2, and therefore depends only on the distance between the sensor tubes S1 and S2 and on the sound velocity of the ground between said sensor tubes S1, S2.

Figure 4:
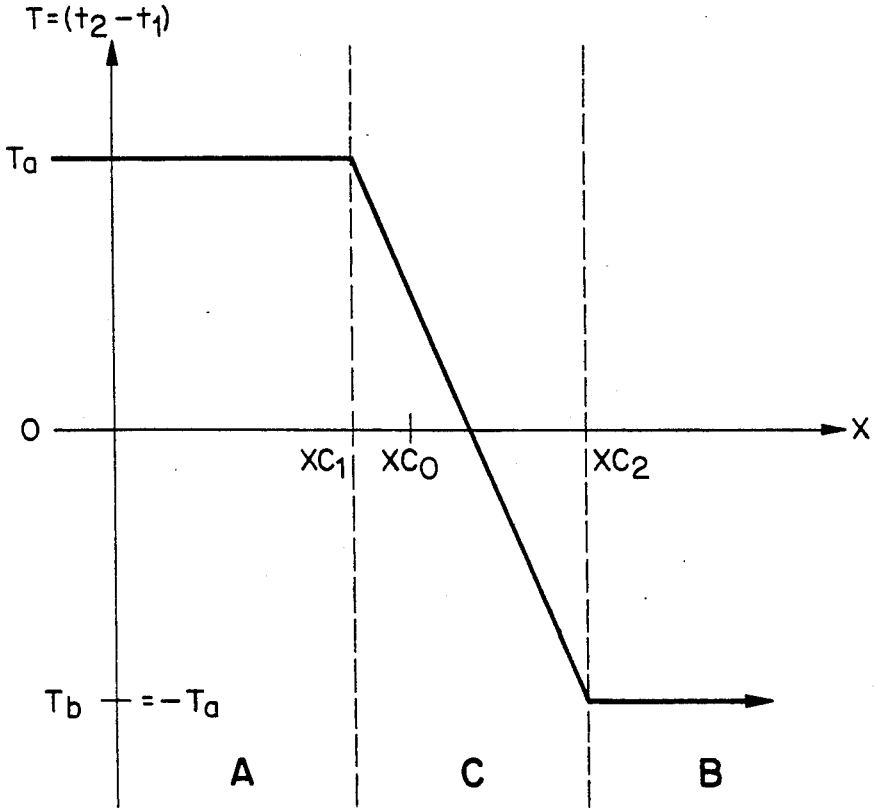
FIG. 4 shows a plot of a typical relation between the time difference of the signals of the two sensor tubes dependent on the location of the seismic waves producing a detectable event.

Since the time difference T is completely independent of the distance of the intruder from the sensor tube S1, i.e., from the boundary to be protected, and independent of the amplitude of the seismic waves, this time difference T is a constant as long as the intruder is in area A as shown in FIG. 4. It may be mentioned here that up to now in the intrusion system of the invention, no interpretation of amplitudes is done, for instance by a threshold detector, but all arriving seismic waves are picked up and processed, if only a certain degree of correlation between the signals of the pressure sensitive cables K1, K2 is determined. The system therefore may be operated with the highest possible sensitivity without having a high false alarm rate. Furthermore, all events causing pressure waves do not produce an alarm as long as they stay in area A, i.e., outside the sensor tube S1, since they have a constant time difference T−(t2−t1).

The resulting signal T of the time discriminator circuit CTD is transmitted to a time difference change circuit TDC which delivers an output signal only if the absolute value of the input signal decreases or if the sign of the input signal changes, i.e., if the input signal becomes negative, within a predetermined time interval. As long as the input signal remains constant, no output signal is produced, i.e., as long as the intruder or another object producing seismic waves stays in the area A, outside the protected boundary. However, as soon as the intruder traverses the outer sensor tube S1 and enters the area C between the sensor tubes S1 and S2, i.e., when he crosses the boundary to be protected and produces seismic waves within area C for instance at point XCO, the time difference T=(t2−t1) is suddenly smaller than the previously constant value Ta or becomes even negative as is shown in FIG. 4. In this case, the time difference change circuit TDC delivers an output signal.

Even if an intruder should try to circumvent the area C between the two sensor tubes S1, S2 by jumping across the sensor tubes S1, S2, he would be detected by the intrusion detection system of the invention, even though he produces no seismic waves in the area C. In this case, he would produce seismic waves in the area B, e.g., at position XBO. These seismic waves are picked up by the pressure sensitive cables K1, K2 at points XB2 and XB1. The time discriminator circuit CTD and the time difference change circuit TDC detect a change of sign of the time difference T=(t2−t1) to the negative value $T_b-T_a$ within a short time interval. Therefore, the time difference change circuit TDC delivers an the time difference change circuit TDC delivers an output signal. It is therefore impossible to defeat the system by jumping over the area C since an output signal will be given if an intruder traverses the area C or jumps across said area C. On the other hand, no output signal is produced if an object producing seismic waves moves only in one of the areas A or B, or if any other event producing seismic waves occurs in these areas.

The output signal, if any, of the time difference change circuit TDC is transmitted to the amplitude discriminator circuit ATH which also receives signals from at least one of the two linear pressure sensors K1 and K2. The amplitudes of the received seismic waves or the time integral of the amplitudes produced by objects near the two sensor tubes S1, S2, i.e., in the entire area C and in the areas A and B in the direct neighborhood of the sensor tubes S1, S2 are dependent on the mass of the object producing seismic waves. Accordingly, it can be determined if there is a big object like a man or a car crossing area C by measuring the amplitude of the seismic waves. Small objects like animals or any debris, for example, tree limbs which may fall in area C are eliminated by the amplitude discriminator circuit ATH. Only if the amplitude or the time integral of the amplitude is in a predetermined range, for instance, exceeds a given threshold, will an alarm signal be transmitted to a display unit DIS. The display unit DIS indicates the alarm condition, e.g., by an indicator lamp, and/or gives an alarm to external stations, if necessary or desired after a certain time delay, e.g., to security personnel or to the police. Moreover, the display unit DIS may function to switch on lamps, video cameras, etc.

Furthermore, the signals of at least one of the electro-acoustic transducers P1, P2 are transmitted to the correlation circuit COR together with the signals of the corresponding pressure sensitive cable K1, K2. It should be noted that the signals produced by K1 and K2 are essentially instantaneous in response to a stimulus at XA1 in FIG. 1, while the response of the fluid in sensors S1 and S2 will be delayed, by a known amount until it reaches SE1. The signal emanating from K1 and the delayed signal coming from the fluid in S1, as sensed by SE1 are analyzed by correlation circuit COR. Similar correlators are described by U.S. Pat. No. 4,746,910.

The correlation circuit COR correlates the incoming signals which show a certain time delay to each other and coordinates them, passing only signals which correlate within a specific time window and blocking all others. The correlated signals are fed to a locating circuit LOC which measures the time difference between the time a signal was created by K1 and the delayed signal from SE1 describing the same event, thus determining the location of the impact of the seismic waves on the sensor tubes S1, or S2. The time delay can be converted, if desired, into distance along S1 or S2 to be displayed on the display DIS. Thus, it is possible to analyze with a high degree of certainty even multiple seismic waves and to determine the location of their origin. By means of the locator circuit LOC it is possible to deliver identifying information as to specific sections of the area to be protected; for instance it may be possible to switch on searchlights only in those regions where an intrusion has been detected.

The control and indication equipment CIE may be constructed using electronic elements well known to those having ordinary skill in the art. Moreover, it is possible to use a programmable microprocessor comprising a suitable program. The parameters of the program may be entered manually, depending on the specific site. They also may be read in automatically after installation of the system by the program running in calibration mode. In this case, it is sufficient to walk slowly around the whole area to be protected in a short distance from the outer sensor tube S1 and parallel thereto. During this walk the system measures continuously the time difference $T=(t2-t1)$ and the amplitudes of the seismic waves, caused by the walking, such that the system automatically establishes all thresholds needed for the specific site.

While there are shown and described presently preferred embodiments of the invention, it is to be clearly understood that the invention is not limited thereto, but may be otherwise variously embodied and practiced without departing from the scope of the following claims.

We claim:

1. A pressure sensitive perimeter intrusion detector comprising at least two pressure sensitive housing members adapted for the transmission of acoustic waves in response to pressure applied to the housing member exteriors, each of said housing members having a first means for detecting said acoustic waves and providing a first electric signal and a second means distributed along each of said housing members for detecting pressure applied along each of said housing members and providing a second electric signal having substantially no time delay, whereby said electric signals are transmitted to an evaluation means adapted to produce an alarm signal in response to the detection of an intrusion occurrence.

2. A pressure sensitive perimeter intrusion detector according to claim 1 wherein each of said housing members contains a fluid and the acoustic waves are detected by a transducer.

3. A pressure sensitive perimeter intrusion detector according to claim 1, wherein said second means for detecting pressure and providing a second electrical signal is selected from the group consisting of piezoelectric and fiber optic means.

4. A pressure sensitive perimeter intrusion detector according to claim 1, wherein said evaluation means comprises a time discriminator circuit being adapted to correlate electrical signals generated by said second pressure sensing means for each of said housing members so as to compute a time difference between said electrical signals and to respond to signals having a correlation degree above a pre-set threshold.

5. A pressure sensitive perimeter intrusion detector according to claim 4, wherein the evaluation means comprises a time difference change circuit capable of receiving as an input signal an output signal transmitted by said time discriminator circuit, said output signal corresponding to said time difference between said electrical signals.

6. A pressure sensitive perimeter intrusion detector according to claim 5, wherein said time difference change circuit is adapted to transmit a signal if the absolute value of said input signal decreases by more than a predetermined value.

7. A pressure sensitive perimeter intrusion detector according to claim 5, wherein the said time difference change circuit is adapted to transmit a signal if the said input signal changes its sign within a predetermined time interval.

8. A pressure sensitive perimeter intrusion detector according to claim 1, wherein the evaluation means comprises an amplitude sensing means for sensing the amplitude of the electrical signals generated by said pressure sensing means.

9. A pressure sensitive perimeter intrusion detector according to claim 8, wherein said amplitude sensing means is adapted to produce an alarm signal when the amplitude of said electrical signals generated by said pressure sensing means exceeds a preset threshold value.

10. A pressure sensitive perimeter intrusion detector according to claim 1, wherein the evaluation means comprises an amplitude time integral sensing means for the electrical signals generated by said pressure sensing means.

11. A pressure sensitive perimeter intrusion detector according to claim 10 wherein said amplitude time integral sensing means is adapted to produce an alarm signal when the time integral of the amplitude of said electrical signals generated by said pressure sensing means exceeds a preset threshold value.

12. A pressure sensitive perimeter intrusion detector according to claim 1, wherein said second pressure sensing means is coaxially located within said housing member.

13. A pressure sensitive perimeter intrusion detector according to claim 1, wherein said second pressure sensing means is embedded within the wall of said housing member.

14. A pressure sensitive perimeter intrusion system according to claim 1, wherein a first and second housing member are attached to each other to maintain a uniform spacing between said first and second housing member.

15. A pressure sensitive perimeter intrusion detector according to claim 1 wherein the evaluating means comprises a correlating circuit and location circuit to determine the location of an intrusion occurrence along the perimeter protected by said detector.

16. A pressure sensitive perimeter intrusion detector comprising at least two pressure sensitive housing members adapted for the transmission of acoustic waves in response to pressure applied to the housing member exteriors, each of said housing members having a first means for detecting said acoustic waves and providing a first electric signal and a second means distributed along each of said housing members for detecting pressure applied along each of said housing members and providing a second electric signal having substantially no time delay, whereby said electric signals are transmitted to an evaluation means adapted to determine the location of an intrusion occurrence along the perimeter protected by said detector.

17. A pressure sensitive perimeter intrusion detector according to claim 16, wherein each of said housing members contains a fluid and the acoustic waves are detected by a transducer.

18. A pressure sensitive perimeter intrusion detector according to claim 16, wherein said second means for detecting pressure and providing a second electrical signal is selected from the group consisting of piezoelectric and fiber optic means.

19. A pressure sensitive perimeter intrusion detector according to claim 16, wherein said first and second electrical signals are transmitted to a correlator circuit.

20. A pressure sensitive perimeter intrusion detector according to claim 19, wherein said correlator circuit is adapted to respond to signals above a pre-set threshold.

21. A pressure sensitive perimeter intrusion detector according to claim 19, wherein output from said correlator circuit is transmitted to a locator circuit, which is adapted to form the time difference between first and second electrical signals.

22. A pressure sensitive perimeter intrusion detector according to claim 21, wherein the output from said locator circuit is transmitted to a display.

* * * * *

UNITED STATES PATENT AND TRADEMARK OFFICE

CERTIFICATE OF CORRECTION

PATENT NO. :5,021,766
DATED :June 4, 1991
INVENTOR(S) :Genahr, et. al.

It is certified that error appears in the above-indentified patent and that said Letters Patent is hereby corrected as shown below:

Column 6, line 35, "an the" should read --an;

Column 6, line 36, delete "time difference change circuit TDC delivers an"; and--.

Column 9, line 2, "member" should read --members--.

Signed and Sealed this

Seventeenth Day of August, 1993

*Attest:*

*Attesting Officer*

BRUCE LEHMAN

*Commissioner of Patents and Trademarks*